US010175021B2

(12) United States Patent
McPherson

(10) Patent No.: US 10,175,021 B2
(45) **Date of Patent: *Jan. 8, 2019**

(54) ARCHERY BOW

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/798,144

(22) Filed: Oct. 30, 2017

(65) Prior Publication Data

US 2018/0051953 A1 Feb. 22, 2018

Related U.S. Application Data

(63) Continuation of application No. 15/449,720, filed on Mar. 3, 2017, which is a continuation of application No. 14/218,362, filed on Mar. 18, 2014, now Pat. No. 9,587,901, which is a continuation of application No. 13/851,009, filed on Mar. 26, 2013, now Pat. No. 8,671,929, which is a continuation of application No. 12/569,738, filed on Sep. 29, 2009, now Pat. No. 8,402,960.

(60) Provisional application No. 61/101,562, filed on Sep. 30, 2008.

(51) Int. Cl.
*F41B 5/14* (2006.01)
*F41B 5/10* (2006.01)

(52) U.S. Cl.
CPC ..... *F41B 5/10* (2013.01); *F41B 5/14* (2013.01); *F41B 5/1426* (2013.01)

(58) Field of Classification Search
CPC ..... F41B 5/10; F41B 5/14; F41B 5/1426
USPC ..... 124/23.1, 25.6, 86, 88, 89
See application file for complete search history.

(56) References Cited

U.S. PATENT DOCUMENTS

| | | | | |
|---|---|---|---|---|
| 2,617,402 | A | 11/1952 | Roemer | |
| 2,714,377 | A | 8/1955 | Mulkey | |
| 3,012,552 | A | 12/1961 | Allen | |
| 3,059,370 | A | 10/1962 | Moore | |
| 3,070,083 | A | 12/1962 | Gubash | |
| 3,258,000 | A | 6/1966 | Kolpacki | |
| 3,658,157 | A | 4/1972 | Lee | |
| 3,757,761 | A | 9/1973 | Izuta | |
| 3,851,638 | A | 12/1974 | Alexander | |
| 3,989,026 | A | 11/1976 | Nishioka | |
| 4,061,125 | A * | 12/1977 | Trotter | F41B 5/14 124/23.1 |

(Continued)

OTHER PUBLICATIONS

PSE Archery 1993 Crossbow Catalog, Precision Shooting Equipment, Inc., Tucson AZ (published 1993).

(Continued)

*Primary Examiner* — Alexander Niconovich

(57) ABSTRACT

In some embodiments, an archery bow comprises a riser comprising a grip, a first limb and a second limb. A drawstring extends between the first limb and the second limb, for example extending between rotatable members supported by the limbs. A first cable, such as a power cable, also extends between the first limb and the second limb. A cable guard is attached to the riser, which comprises a body portion and a cable engaging portion. The cable guard biases a portion of the first cable in a direction away from the riser.

20 Claims, 11 Drawing Sheets

(56) References Cited

U.S. PATENT DOCUMENTS 4,203,412 A 5/1980 Rickard
4,207,858 A * 6/1980 Blackstone ..... F41B 5/10 124/25.6
4,461,267 A * 7/1984 Simonds ..... F41B 5/10 124/25.6
4,519,374 A 5/1985 Miller
4,562,824 A 1/1986 Jennings
4,570,606 A 2/1986 Peck
4,628,892 A 12/1986 Windedahl
4,662,344 A 5/1987 Mitchell
4,705,015 A 11/1987 Troncoso, Jr.
4,718,397 A 1/1988 Remick
4,817,580 A 4/1989 Butterfield
4,834,061 A 5/1989 Chattin
4,879,987 A * 11/1989 Nishioka ..... F41B 5/123 124/25
4,903,677 A 2/1990 Colley et al.
4,917,070 A * 4/1990 Townsend ..... F41B 5/10 124/23.1
4,919,108 A 4/1990 Larson
4,971,020 A 11/1990 Soderstrom et al.
5,054,463 A 10/1991 Colley et al.
5,323,756 A 6/1994 Rabska
5,353,777 A 10/1994 Fincher
5,415,149 A 5/1995 Derus et al.
5,452,704 A 9/1995 Winebarger
5,503,135 A 4/1996 Bunk
5,718,213 A * 2/1998 Gallops, Jr. ..... F41B 5/10 124/25.6
5,720,269 A * 2/1998 Saunders ..... F41B 5/1407 124/25.6
5,722,385 A * 3/1998 Bunk ..... F41B 5/10 124/25.6
5,983,880 A 11/1999 Saunders
6,152,124 A 11/2000 Gallops, Jr.
6,257,220 B1 7/2001 McPherson et al.
6,382,201 B1 5/2002 McPherson et al.
6,681,753 B2 1/2004 Afshari
6,681,754 B1 1/2004 Angeloni
6,681,755 B2 1/2004 Pujos
6,715,479 B1 4/2004 Bunk
6,722,354 B1 * 4/2004 Land ..... F41B 5/10 124/25.6
6,966,314 B2 11/2005 McPherson
7,793,646 B2 9/2010 Cooper
8,011,356 B2 9/2011 Gordon
RE42,842 E 10/2011 McPherson
8,028,685 B2 10/2011 Clark
8,056,548 B1 11/2011 Larson
8,176,906 B2 5/2012 Simo et al.
8,272,374 B2 9/2012 Cooper
8,567,381 B2 10/2013 Saunders
8,813,737 B2 * 8/2014 Langley ..... F41B 5/14 124/25.6
8,950,388 B2 * 2/2015 McPherson ..... F41B 5/1403 124/25.6
9,046,317 B2 * 6/2015 McPherson ..... F41B 5/1426
9,140,515 B2 9/2015 Yi
9,291,422 B1 * 3/2016 Gold ..... F41B 5/1403
9,587,901 B2 3/2017 McPherson
2003/0136392 A1 7/2003 McPherson
2008/0127961 A1 6/2008 McPherson
2009/0032005 A1 2/2009 Wright
2009/0071457 A1 3/2009 Gordon
2009/0071458 A1 3/2009 Gordon
2010/0083943 A1 4/2010 Grace
2010/0089375 A1 4/2010 McPherson
2010/0132685 A1 6/2010 De Sousa
2010/0224178 A1 * 9/2010 McPherson ..... F41B 5/1426 124/25.6
2010/0282226 A1 * 11/2010 Marzullo ..... F41B 5/10 124/25.6
2010/0319670 A1 * 12/2010 Sims ..... F41B 5/1426 124/89
2011/0011385 A1 1/2011 Grace, Jr.
2011/0048394 A1 3/2011 Simo
2011/0073090 A1 3/2011 McPherson
2011/0192385 A1 * 8/2011 Clark ..... F41B 5/10 124/25.6
2011/0214656 A1 9/2011 Saunders
2011/0247602 A1 10/2011 McPherson
2012/0042861 A1 * 2/2012 Anselmo ..... F41B 5/10 124/25.6
2012/0042864 A1 2/2012 McPherson
2014/0014083 A1 1/2014 Saunders

OTHER PUBLICATIONS

PSE Archery 1996 Product Catalog, Precision Shooting Equipment, Inc., Tucson AZ (published 1996).

* cited by examiner

ARCHERY BOW

CROSS-REFERENCE TO RELATED APPLICATIONS

This application is a continuation of U.S. patent application Ser. No. 15/449,720, filed Mar. 3, 2017, which is a continuation of U.S. patent application Ser. No. 14/218,362, filed Mar. 18, 2014, which is a continuation of U.S. patent application Ser. No. 13/851,009, filed Mar. 26, 2013, now U.S. Pat. No. 8,671,929, which is a continuation of U.S. patent application Ser. No. 12/569,738, filed Sep. 29, 2009, now U.S. Pat. No. 8,402,960, which claims the benefit of and is a non-provisional of U.S. Provisional Application No. 61/101,562, filed Sep. 30, 2008, the entire content of each of which are hereby incorporated herein by reference.

BACKGROUND OF THE INVENTION

This invention relates generally to archery bows and more specifically to an archery bow with increased shooting speed and reduced vibration and noise.

All U.S. patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an archery bow comprises a riser, a first limb and a second limb. A drawstring extends between the first limb and the second limb, as does a first cable. A cable guard is attached to the riser, comprising a body portion and a cable engaging portion. The cable engaging portion applies a lateral force to the first cable, wherein the lateral force is greater in a brace condition than in a drawn condition.

In some embodiments, an archery bow comprises a riser, a first limb and a second limb. A drawstring extends between the first limb and the second limb, and a first cable extends between the first limb and the second limb. A cable guard is attached to the bow riser. The cable guard comprises a body portion and cable engaging portion. The body portion comprises a compression member and the cable engaging portion engages the first cable.

In some embodiments, an archery bow comprises a riser, a first limb and a second limb. A drawstring extends between the first limb and the second limb, for example extending between rotatable members supported by the limbs. The drawstring moves in a drawstring plane as the bow is drawn. A first cable, such as a power cable, also extends between the first limb and the second limb. A cable guard is attached to the riser, which comprises a body portion and a cable engaging portion. The cable guard biases a portion of the first cable in a direction away from the riser, wherein a component of the biasing is in or parallel to the drawstring plane.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
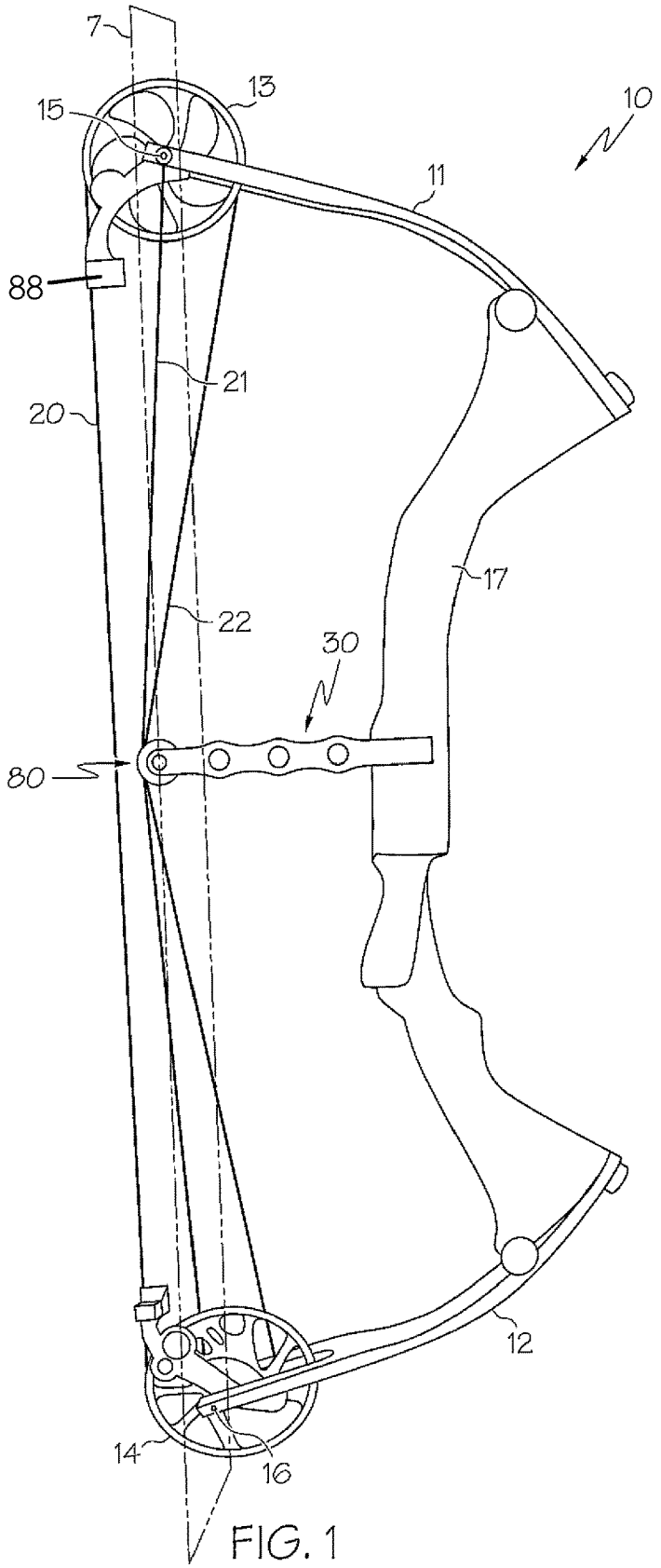
FIG. 1 shows an embodiment of a compound archery bow in brace position.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a compound archery bow 10. The compound archery bow 10 comprises a riser 17, a first limb 11 and a second limb 12. A first rotatable member 13 is disposed at or near the end of the first limb 11 while a second rotatable member 14 is disposed at or near the end of a second limb 12. The first rotatable member 13 rotates around a first shaft 15 and the second rotatable member 14 rotates around a second shaft 16.

A drawstring or bowstring 20 is strung between the first limb 11 and the second limb 12, and is retained at least in-part by rotatable members 13, 14. The drawstring can be strung between the first rotatable member 13 attached to the first limb 11 and the second rotatable member 14 attached to the second limb 12. A first cable 21 extends from the first limb 11 to the second limb 12, and is retained at least in-part by a rotatable member. In some embodiments, a second cable 22 extends from the second limb 12 to a first limb 11, and is retained at least in-part by a rotatable member. The first and second cables 21, 22 can be anchored on one end to a limb, limb shaft or a first rotatable member, and on the other end to a second rotatable member, including a cam or pulley, for example as in a dual-cam bow. Alternatively, the first and second cables can be anchored on both ends to a rotatable member, for example as in a binary-cam bow. In some embodiments, the first and second cables 21, 22 can take on a configuration for a single-cam bow, cam-and-a-half bow or any other known compound bow. The first cable 21 typically comprises a buss cable or power cable. The second cable 22 can comprise a buss cable, power cable, control cable or any other similar cross cable or portion of cable. Furthermore, in some embodiments, the second cable can comprise a portion of the drawstring, for example in a single-cam bow.

In some embodiments, a bow further comprises one or more suppressors 88 configured to reduce vibration and noise in the drawstring 20. Examples of a suitable suppressor are described in U.S. Pat. No. 6,966,314.

A plane 7 is shown extending between the first and second shafts 15, 16. The plane 7 is aligned longitudinally with the first and second shafts 15, 16. As shown in FIG. 1, a portion of the cable guard 30 extends through the plane 7. In some embodiments, a portion of said cable guard 30 that contacts/engages the bowstring 20 can be located on an opposite side of the plane 7 from the riser 17.

As the bow 10 is drawn, the shafts 15, 16 will generally move toward one another, reducing the distance between the shafts 15, 16. The shafts 15, 16 can also move toward the shooter, thereby shifting the location of the plane 7 with respect to the cable guard 30. As the bow 10 is drawn, the drawstring 20 will move through its own drawstring plane, which is oriented at an angle to the plane 7 (e.g. orthogonal).

Figure 2:
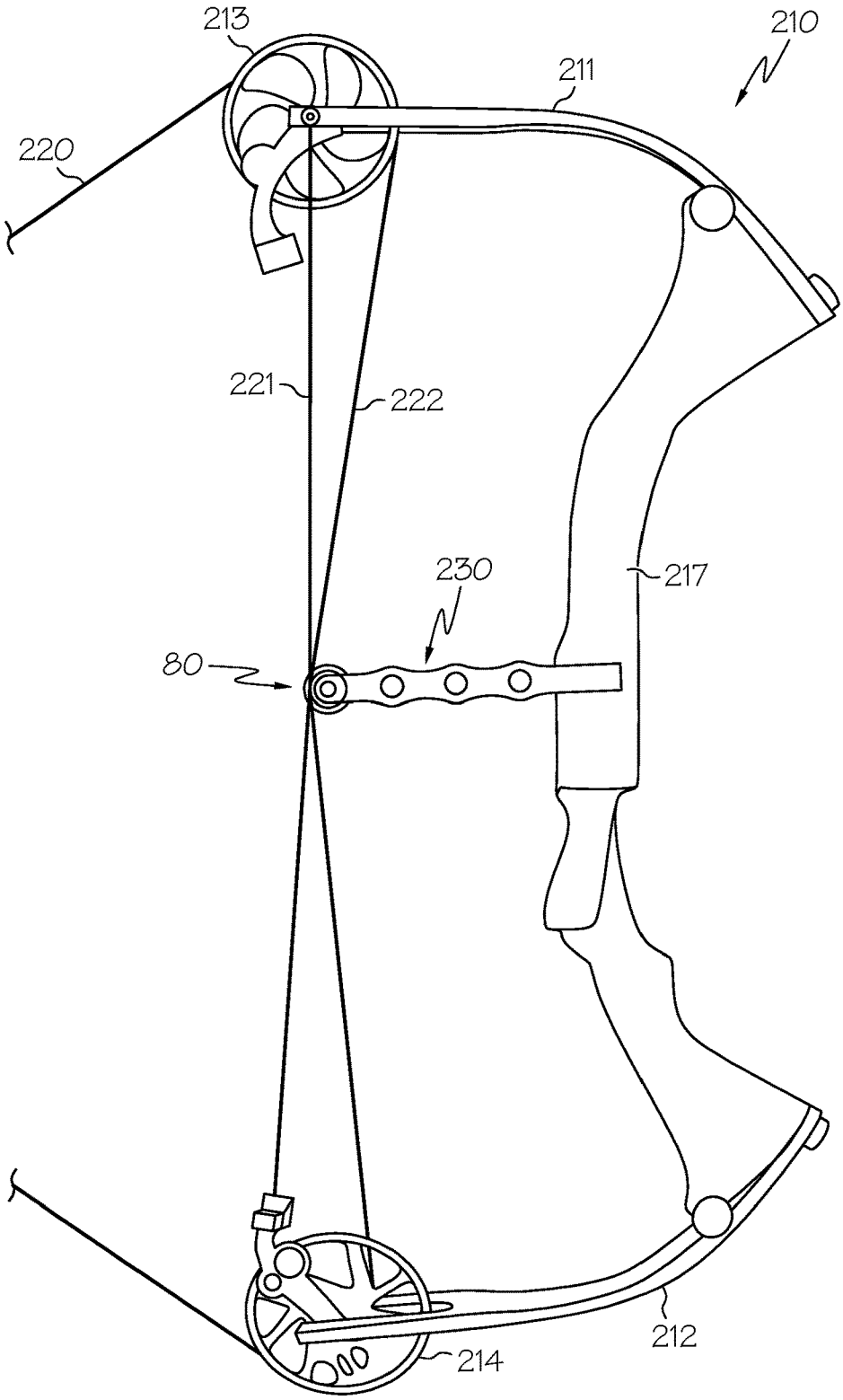
FIG. 2 shows an embodiment of a compound archery bow in a drawn position.

FIG. 2 shows a compound archery bow 210 in a full draw position. As shown in FIG. 2, the compound archery bow 210 has a drawstring 220 disposed between the first and second rotatable members 213, 214. A first cross cable 221 and a second cross cable 222 are disposed between the first limb 211 and the second limb 212, as discussed previously. The compound archery bow 210 comprises a cable guard 230 attached to the riser 217.

As the compound archery bow 210 is drawn from a brace position (shown in FIG. 1) to a full draw position (shown in FIG. 2), the lateral displacement of the cross cables can decrease at the center of their span, and the shafts 15, 16 can move closer to the engagement region 80 between the cable(s) 21, 22 and the guard 30. For example, the plane 7 can move closer to the engagement region 80 as the bow is drawn. Thus, the amount of lateral force applied to the cable(s) 21, 22 by the guard 30 in the direction of bowstring travel can be less at full draw than the amount of lateral force applied in the brace condition. Also, the size of a contact area between each cable 21, 22 and the guard 30 in a drawn condition can be less than in a brace condition. This configuration can reduce the noise and vibrations present in the cable(s) 21, 22 when compared to a prior art bow, and the cable guard 30 disclosed herein results in a bow that is more comfortable for an archer to shoot.

Returning to FIG. 2, as the bow returns from a drawn position to a brace position, the lateral force placed on the roller guard 230 by the cross cables 221, 222 increases. An increasing lateral force on the cross cables acts to minimize oscillation by insuring that the cross cables stay taught throughout arrow launch. In some embodiments, lateral force in the roller guard is highest when the bow is at brace position and lowest when the bow is fully or nearly fully drawn.

Figure 3:
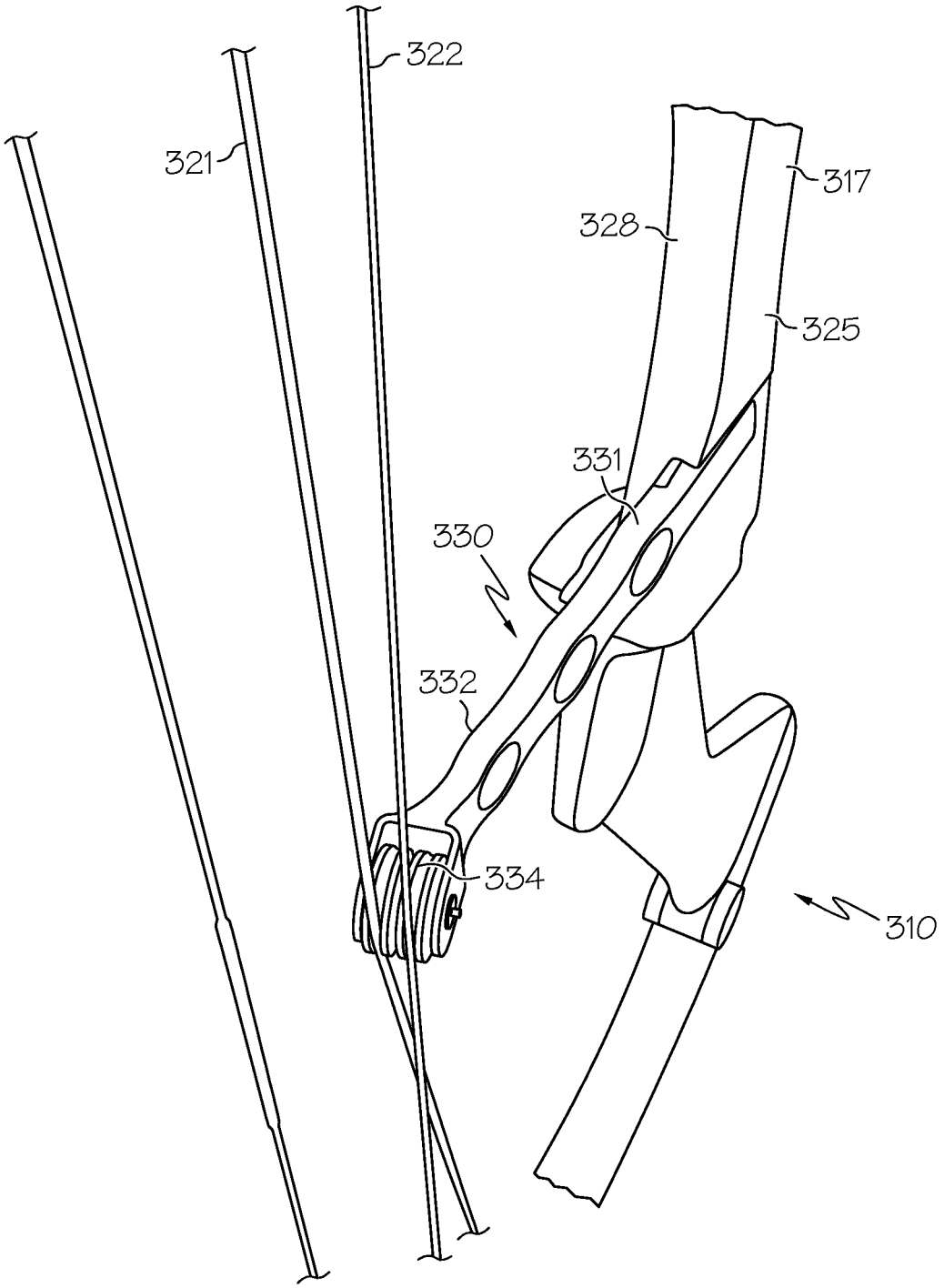
FIG. 3 is a detailed fragmentary view of an archery bow showing an embodiment of a cable guard.

In FIG. 3, a cable guard 330 is shown attached to the riser 317 of the compound archery bow 310. The cable guard 330 can be attached to a first side 325 of the riser 317, a second side (not shown) of the riser 317, the front (not shown) of the riser 317 or the back 328 of the riser 317. Additionally, the cable guard 330 can be attached to more than one side of the riser 317, for example the back 328 and first side 325 of the riser 317, as shown in FIG. 3.

The cable guard 330 has a body portion 331 and a cable engaging portion 334. As shown in FIG. 3, the cable engaging portion 334 is configured to engage a first cable 321. The cable engaging portion 334 is supported by the body portion 331. In some embodiments, the body portion 331 is a rigid structure made of aluminum or magnesium. The body portion 331 can also be made of a metal alloy, composite material, plastic, or any other suitable material or combination of materials.

In some embodiments, the location of the cable engaging portion 334 is fixed along the length of the body portion 331.

A portion of the first cable 321 engages a portion of the cable engaging portion 334 generally facing the archer. The cable engaging portion 334 maintains a first cable 321 a fixed distance away from the riser. Similarly, where a second cable 322 is used, the cable engaging portion 334 can maintain the second cable 322 a fixed distance away from the riser. The biasing of cables 321, 322 shown in FIG. 3 includes lateral and longitudinal components. A longitudinal component of the biasing is oriented in, or parallel to, a drawstring plane defined by the drawstring 20 during draw, and is oriented away from the riser.

In some embodiments, the body portion 331 comprises a flexural member supporting the cable engaging portion 334. The cables 321, 322 can apply bending stresses and axial compressive stresses to the body portion 331.

In some embodiments, the body portion 331 can comprise a compression portion, which can remain loaded in compression from brace position to full draw.

Figure 4:
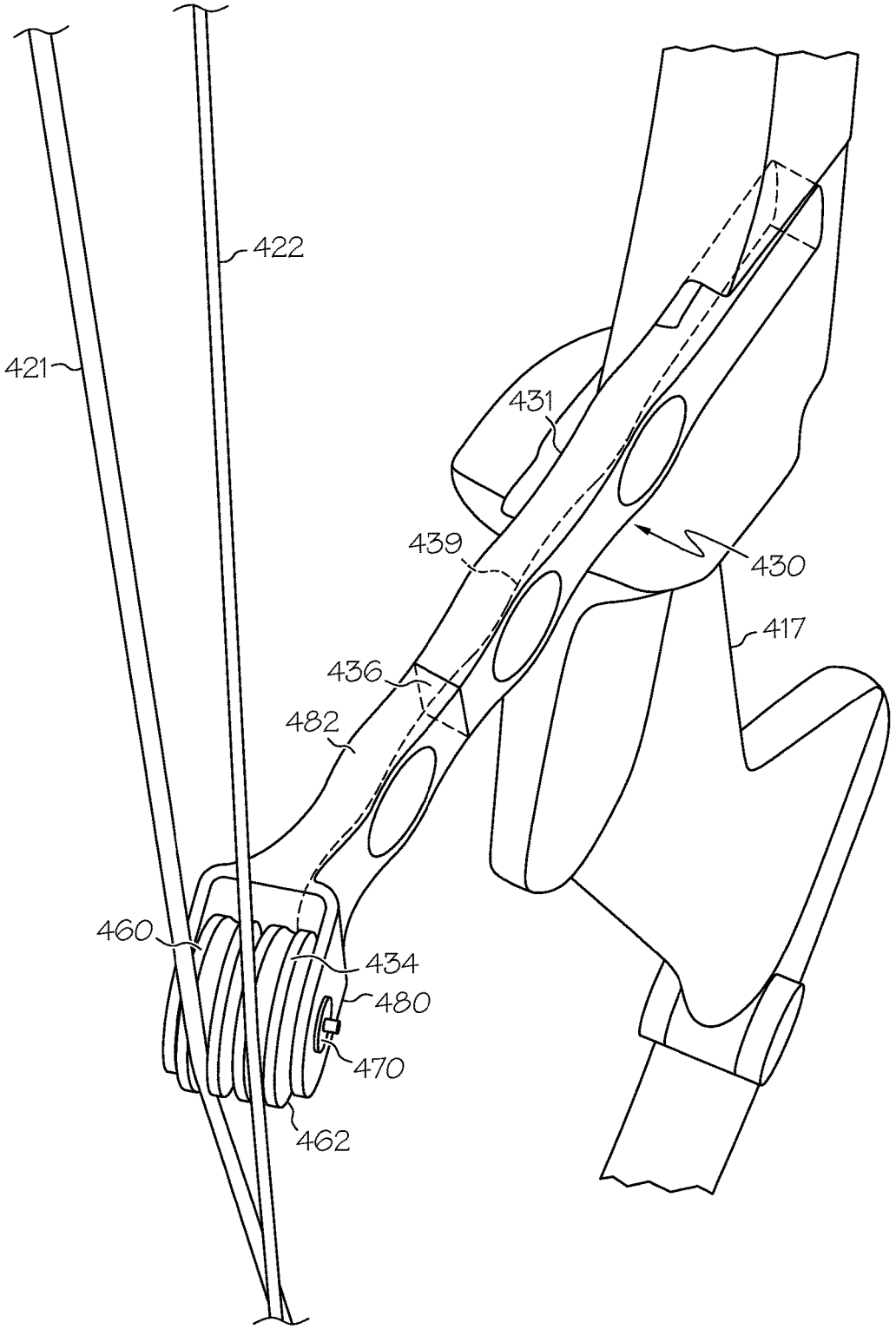
FIG. 4 shows the cable guard of FIG. 3 in greater detail.

In some embodiments, as shown in FIG. 4, a body portion 431 has a central axis 439. Central axis 439 extends along the length of the body portion 431. In some embodiments, the body portion 431 can be symmetrical across the central axis 439 when viewing the archery bow from the side. Additionally, the body portion 431 can be symmetrical across the central axis 439 when viewing the archery bow from above (not shown). In some embodiments, the body portion 431 can be symmetrical or asymmetrical across the central axis 439 when viewed from any or every orientation. For example the body portion can be cylindrical.

The body portion 431 of the cable guard 430 has a cross-section 436. The cross-section 436 is oriented orthogonal to the central axis 439 of the body portion 431.

In some embodiments, the body portion 431 can comprise a canted portion 480 and a straight portion 482. The canted portion 480 can be subject to bending and compressive forces applied by the cross cable(s) 421, 422, acting on the engaging portion 434. In some embodiments, the body portion 431 can comprise a straight portion or portions, a canted portion or portions, a curved portion or portions and combinations thereof.

In some embodiments (not shown), the body portion 431 can comprise a compression member, and an entire cross-section 436 can be subject to compressive stress.

In some embodiments, the body portion 431 is generally uniform along its length. In some embodiments, the body portion 431 can taper along its length. For example, body portion 431 can have a wider-cross section 436 near the riser 417 compared to a cross-section 436 near the cable engaging portion 434.

As shown in FIG. 4, the cable engaging portion 434 comprises a first pulley 460 or roller. The first pulley 460 is rotatably mounted on an axle 470 and configured to engage a first cable 421. Cable guard 430 further comprises a second pulley 462. The first pulley 460 is configured to engage a first cable 421 and the second pulley 462 is configured to engage a second cable 422. The first and second pulleys 460, 462 are situated to prevent the first and second cables 421, 422 from rubbing against each other and to provide clearance for an arrow fletching (not shown).

Axle 470 is disposed through a hole (not shown) in the body portion 431. In some embodiments, the axle 470 is retained in the hole of the body portion 431 by a c-clip or e-clip, snap-ring, or the like. Additionally, the pulley 460 can be retained on the axle 470 by a c-clip or e-clip, snap-ring, or the like.

The first and second pulleys 460, 462 can be mounted on a common axle 470. As discussed previously, the axles may be retained by a c-clip or e-clip, snap-ring or the like. Additionally, the pulleys may be held on the axle by similar style retaining fasteners. Other retaining devices and methods may also be used, for example, press fitting the pulley onto the axle and/or the axle into the hole, welding, gluing or any other known method. Furthermore, the hole does not have to extend through the body portion 331; the hole can be, for example, a blind hole.

Figure 5:
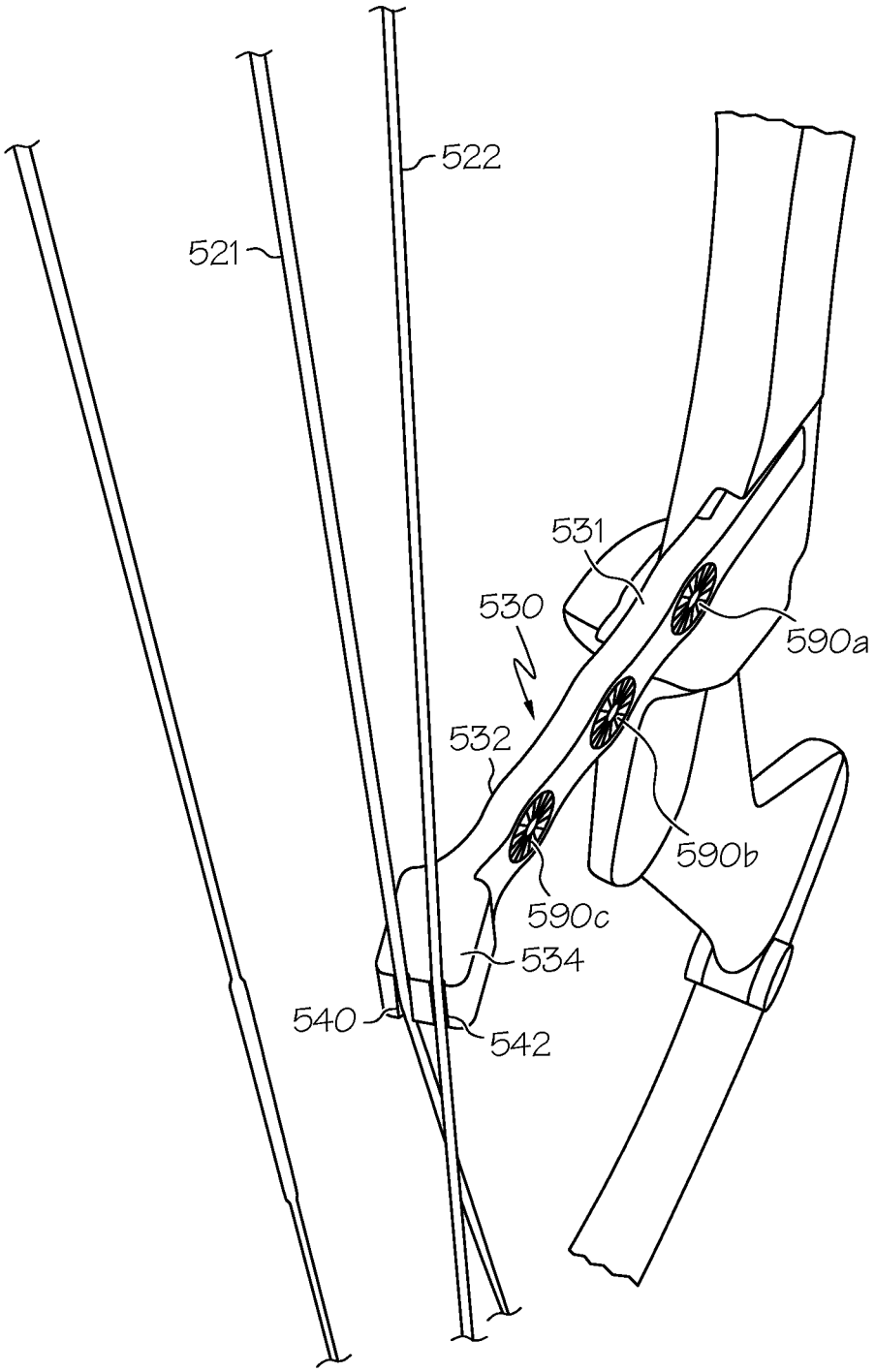
FIG. 5 is a detailed fragmentary view of an archery bow comprising another embodiment of a cable guard.

FIG. 5 shows a detailed view of another embodiment of the cable guard 530. Cable guard 530 has body portion 531 comprising a compression member 532 and a cable engaging portion 534. In some embodiments, the cable engaging portion 534 comprises a first groove 540. First groove 540 is configured to engage a first cable 521.

As shown in FIG. 5, the cable engaging portion has a second groove 542 is configured to engage a second cable 522 such that the second cable 522 is oriented in the second groove 542. First and second grooves 540, 542 retain the first and second cables 521, 522 a fixed distance away from the riser (not shown).

The body portion 531 has a plurality of vibration dampers 590 as taught in McPherson (U.S. Pat. No. 6,382,201). Vibration dampers 590 can all be the same as one another, or they can be different from each other. In some embodiments, the vibration dampers 590*a*, 590*b*, 590*c* are of varying sizes. Some embodiments (not shown) may comprise a single vibration damper.

Figure 6:
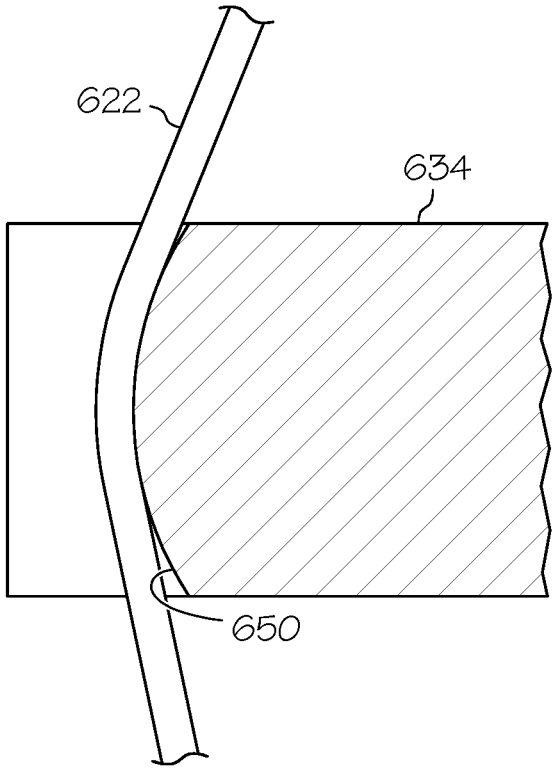
FIG. 6 is a cross sectional view of an embodiment of a cable guard engaging portion.

Shown in FIG. 6 is a longitudinal cross sectional view of one embodiment of the cable engaging portion 634. In some embodiments, the cable engaging portion 634 can have a rounded or radiused profile 650, for example being convex with respect to the cable 622. The rounded profile 650 permits the cable 622 to smoothly traverse the groove as the drawstring (not shown) is pulled back or released. Other profiles, including arcuate and straight, or combinations thereof can also be employed. The cable engaging portion 634 can also have a rounded or radiused shape as viewed from the top, shown in FIG. 5, and a rounded or radiused shape as viewed from the bottom. In some embodiments the cable engaging portion 634 is symmetrical across an axis (not shown).

Cable engaging portion 634 comprises a material having a low frictional coefficient to permit sliding of the cable 622 within the groove (not shown).

Figure 7:
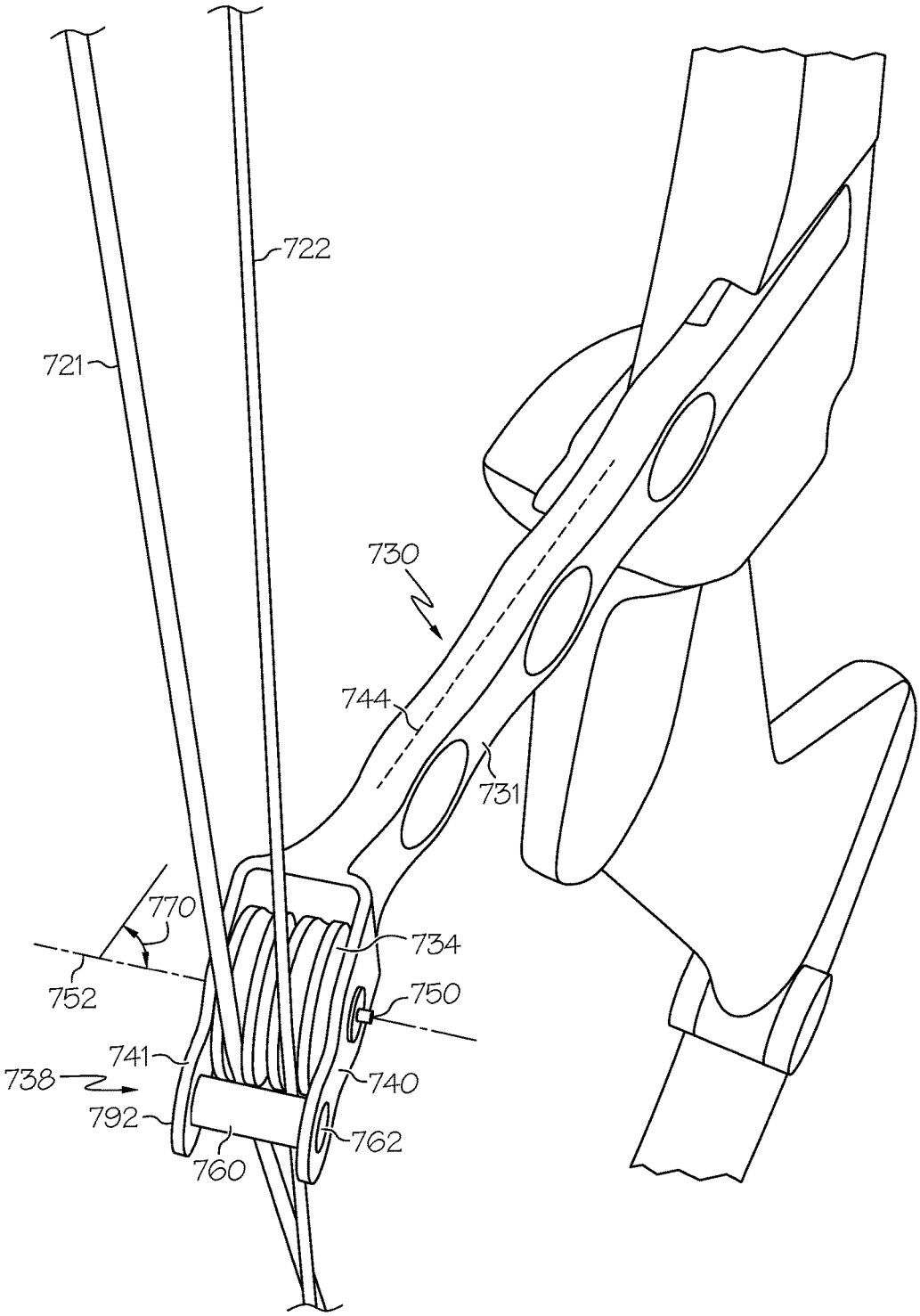
FIG. 7 is a detailed fragmentary view of an archery bow showing another embodiment of a cable guard.

As shown in FIG. 7, in some embodiments, the cable guard 730 comprises a guard portion 792. The guard portion can fully surround cross cables 721, 722, as shown in FIG. 7. Alternatively, the guard portion can partially surround the cross cables 721, 722, for example in a configuration that will retain the cables 721, 722 during normal bow operation but will allow serviceability such that a cable 721, 722 can be biased outside of the guard portion 792 by a technician without disconnecting an end of the cable 721, 722. In some embodiments, the guard portion 792 is integral with the body portion 731.

In some embodiments, the body portion 731 comprises sidewall portions 740, 741 arranged to support a journal 750. The journal 750 is arranged to support one or more cable engaging portions 734, such as a roller. In some embodiments, the sidewall portions 740, 741 extend past the cable(s) 721, 722 such that the body portion 731 forms a closed structure that extends around the cable(s) 721, 722. In some embodiments, the closed structure comprises a removable member 760 that allows the cable(s) 721, 722 to be easily removed from the closed structure. A removable member 760 can attach to the body portion 731 using any suitable connection, such as one or more fasteners 762, such as allen screws. In some embodiments, a removable member 760 is convex with respect to the interior of the closed structure, for example comprising a cylindrical shape.

In some embodiments, the body portion 731 defines a longitudinal axis 744, and an end portion 738 of the body 731 is bent in a direction away from the unbiased position of the cable(s) 721, 722 (e.g when the cables are not biased by the cable guard 730. In some embodiments, a central axis 752 of the journal 750 is oriented at an angle 770 to the body portion axis 744. In various embodiments, the angle 770 ranges from less than 45 degrees to greater than 85 degrees. In some embodiments, the angle ranges from 60 to 80 degrees. In some embodiments, the angle is approximately 70 degrees.

The guard portion can also be a separate structure attached to the body portion, for example, after the archery bow is strung.

In some embodiments, bracing the cross cables away from the riser allows for a shorter brace height. Bracing the cross cables away from the riser with a cable positioning member as disclosed herein permits the cams/pulleys to be configured closer to the vertical section of the riser, thereby decreasing the brace height and increasing arrow launch speed.

Figure 8:
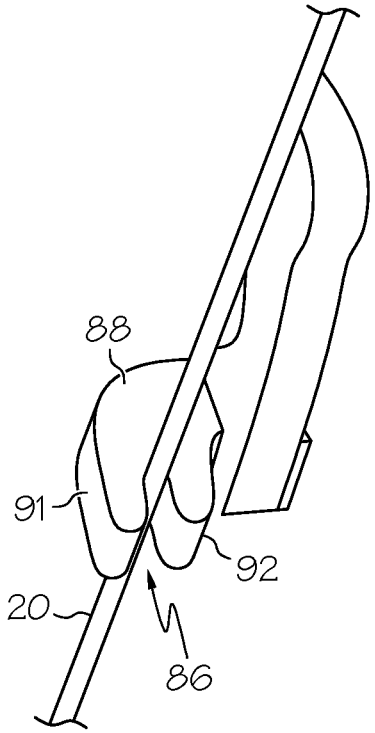
FIG. 8 shows an embodiment of a bowstring vibration and noise suppressor.

FIG. 8 shows an embodiment of a vibration and noise suppressor 88 comprising a groove 86. The suppressor 88 can be positioned such that the bowstring 20 is oriented in the groove 86 in the brace condition. A width of the groove 86 can be approximately equal to or less than a diameter of the bowstring 20, such that the suppressor 88 can damp lateral travel of the bowstring 20 and any lateral vibrations present in the bowstring 20. The suppressor 88 can comprise a first lobe 91 and a second lobe 92 positioned across the groove 86. FIG. 8 shows the lobes 91, 92 being symmetrical across the groove 86.

Figure 9:
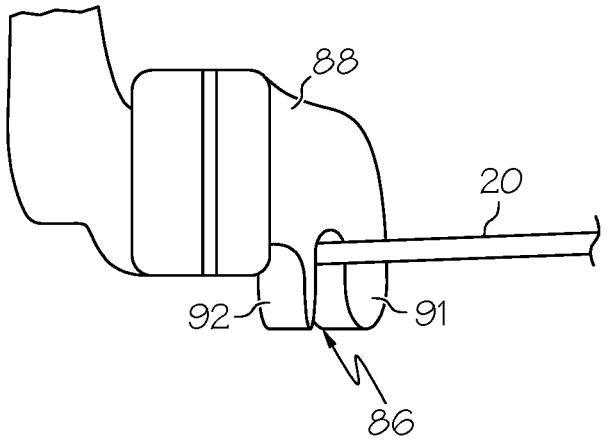
FIG. 9 shows another embodiment of a bowstring vibration and noise suppressor.

FIG. 9 shows another embodiment of a vibration and noise suppressor 88 comprising a groove 86. A first lobe 91 can be different from a second lobe 92, for example being different in size, shape and/or damping characteristics.

Referring again to FIG. 1, a plane 7 has been described that moves closer to the engagement region 80 between the cable guard 30 and the cables 21, 22 as the bow is drawn. The plane 7 extends between the bow limb axles 15, 16. Similarly, additional lines/planes can be considered that move closer to the engagement region 80 as the bow is drawn. For example, a line defined between the points at which a cable 22 initially contacts either rotatable member 13, 14, or a line defined between the points at which a cable 21 initially contacts a shaft and a rotatable member 14, can exhibit similar travel.

In some embodiments, a cable guard 30 applies a lateral force to a cable at a brace condition and at a full draw condition. In some embodiments, the lateral displacement to a cable applied in the brace condition is greater than the lateral displacement applied in the full draw condition. In some embodiments, the lateral force applied in the brace condition is greater than the lateral force applied in the full draw condition. In some embodiments, the lateral force continuously increases as the bow transitions from the full draw condition to the brace condition.

Figure 10:
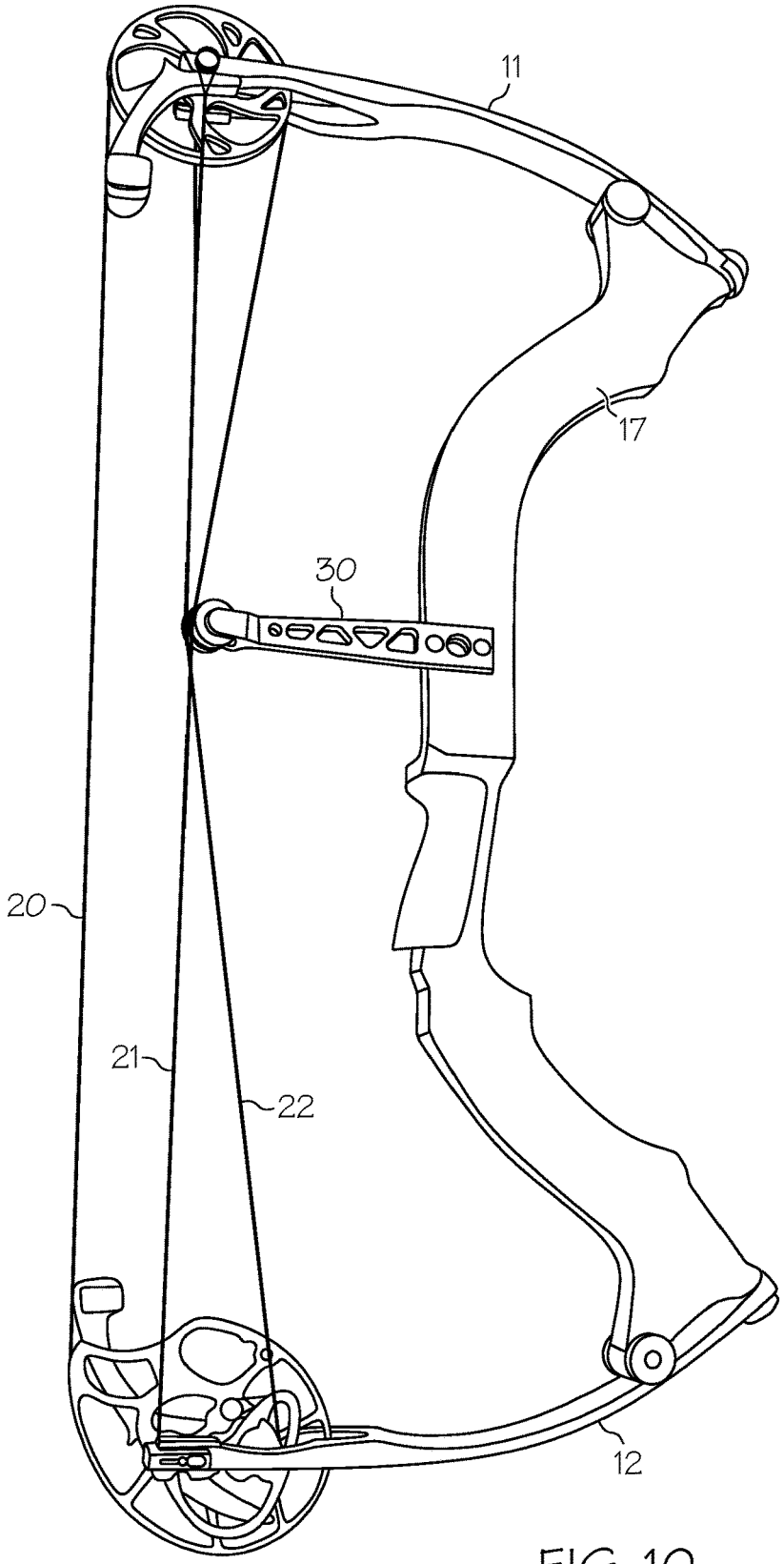
FIG. 10 shows a bow comprising another embodiment of a cable guard.

FIG. 10 shows another embodiment of a cable guard 30. In some embodiments the body portion comprises a truss framework, for example comprising tension and/or compression members.

Figure 11:
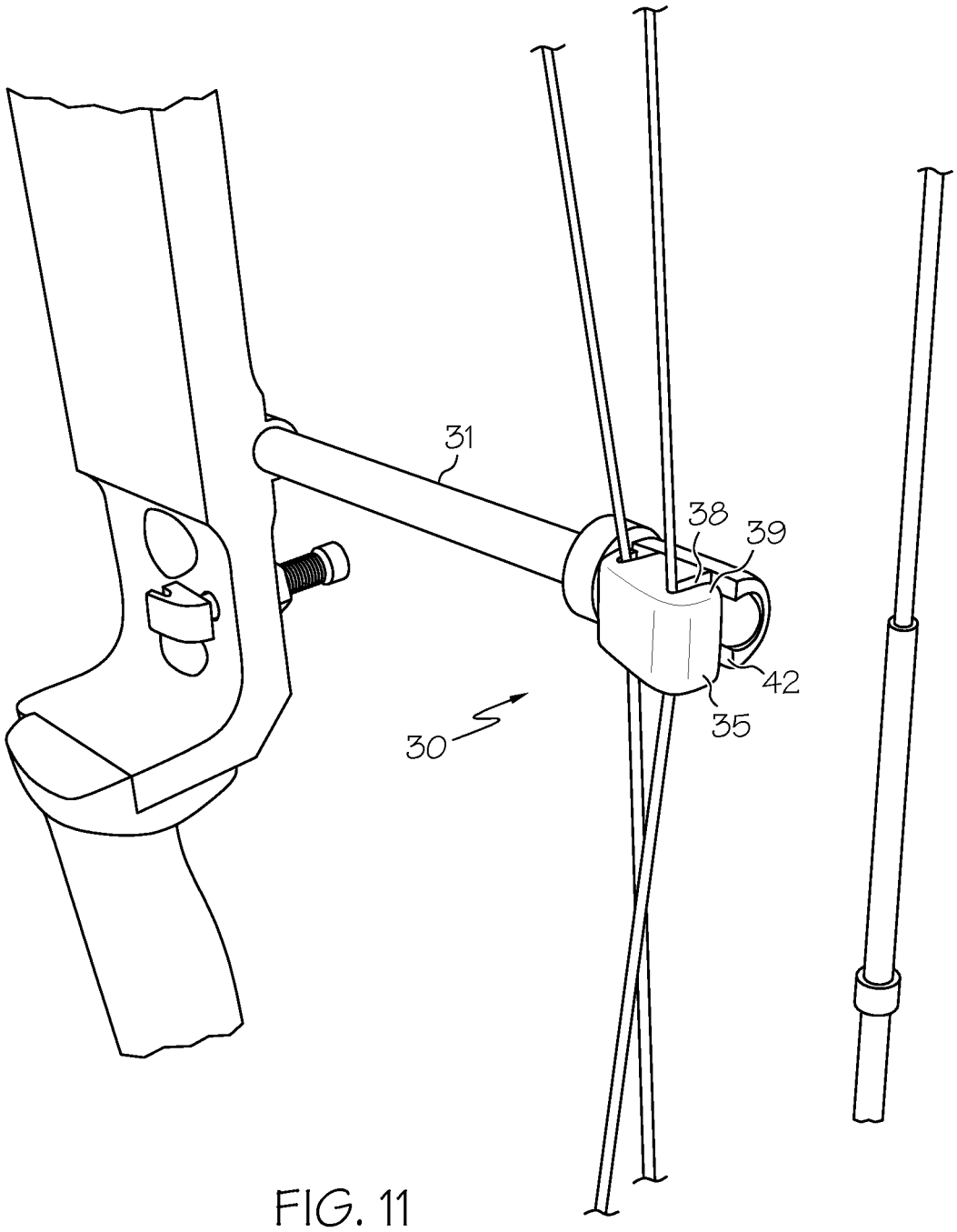
FIG. 11 shows another embodiment of a cable guard.
Figure 12:
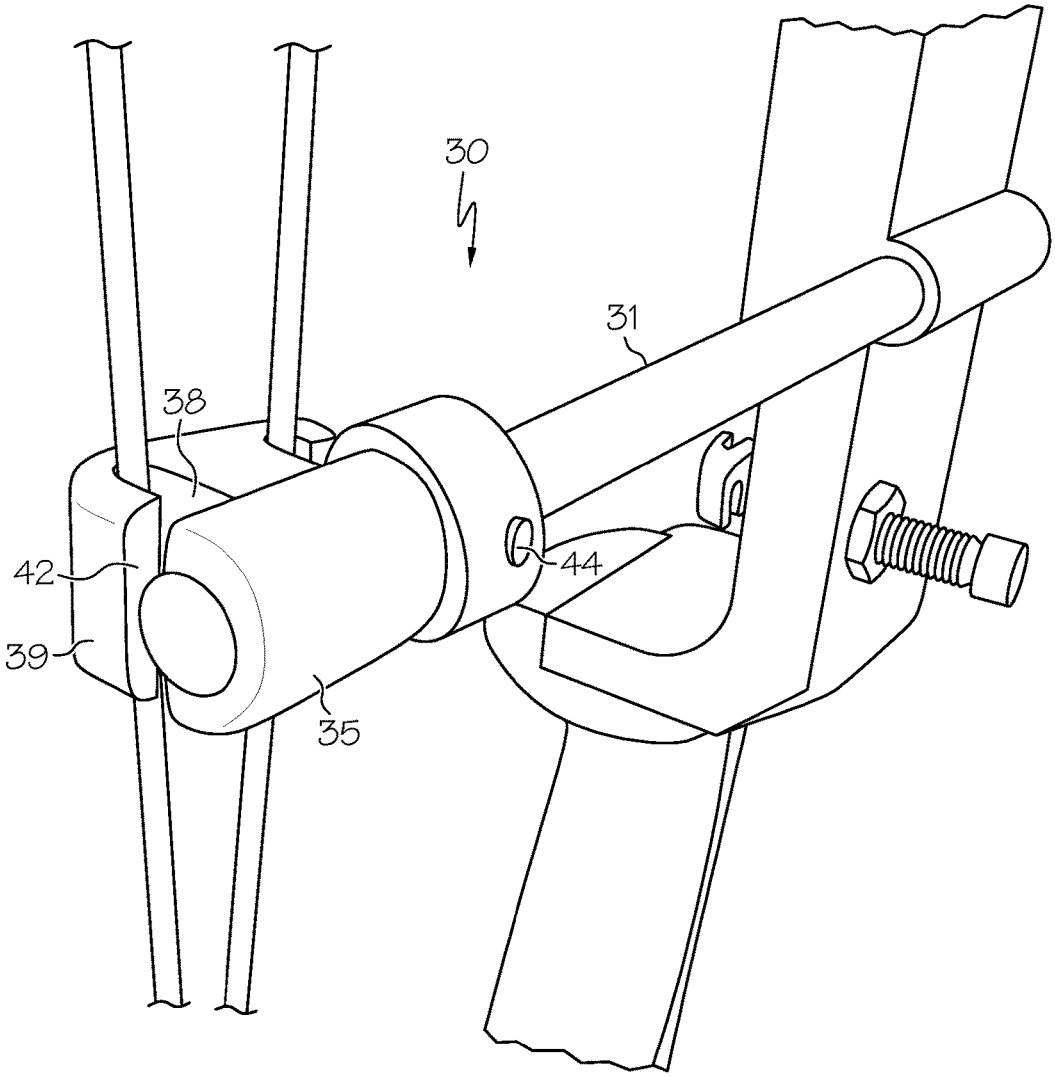
FIG. 12 shows a different view of the cable guard of FIG. 11.

FIGS. 11 and 12 show another embodiment of a cable guard 30. In some embodiments, the body portion comprises a shaft 31. The cable guard 30 further comprises a retaining member 35 that is removable from the shaft 31. The retaining member 35 is preferably fixedly attached to the shaft 31 when in a proper position, for example using a fastener 44, such as an allen screw.

In some embodiments, the retaining member 35 comprises a cavity or lumen suitable to receive the shaft 31. In some embodiments, the retaining member 35 comprises one or more grooves 38 for retaining a cable. In some embodiments, a length of a groove 38 is oriented orthogonal to a longitudinal axis of the body portion/shaft 31. In some embodiments, the retaining member 35 comprises a hook portion 39 that defines the groove 38 and provides for a slot 42 that allows a cable to be positioned in the groove 38. Desirably, the hook portion 39 is dimensioned such that a cable can be placed into the groove 38 or removed from the groove when the retaining member 35 is detached from the shaft 31, but the cable is retained in the groove 38 by the shaft 31 when the shaft 31 is positioned to extend through the cavity or lumen defined by the retaining member 35.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow having a brace condition and a drawn condition, the archery bow comprising:

a riser comprising a grip, a first limb and a second limb;

a drawstring extending between the first limb and the second limb;

a first cable extending between the first limb and the second limb;

a second cable extending between the first limb and the second limb; and a cable guard attached to the riser, the cable guard comprising a body portion and a cable engaging portion, the cable guard biasing a portion of said first cable away from the riser, the cable guard contacting the first cable at a single location, the cable guard biasing a portion of said second cable away from the riser;

wherein the archery bow defines a shooting axis and the biasing comprises a component oriented parallel to the shooting axis and directed away from the riser.

2. The archery bow of claim 1, said first cable comprising a first straight segment located to a first side of the cable engaging portion and a second straight segment located to a second side of the cable engaging portion, said first straight segment and said second straight segment forming a first interior angle of less than 180 degrees, said first interior angle facing the riser.

3. The archery bow of claim 2, said second cable comprising a first straight segment located to a first side of the cable engaging portion and a second straight segment located to a second side of the cable engaging portion, said first straight segment and said second straight segment forming a second interior angle of less than 180 degrees, said second interior angle facing the riser.

4. The archery bow of claim 1, said drawstring moving in a plane as the bow is drawn, said shooting axis oriented in said plane.

5. The archery bow of claim 1, wherein said cable engaging portion comprises a groove, and a portion of said first cable is oriented in said groove.

6. The archery bow of claim 5, wherein said groove is oriented orthogonal to a longitudinal axis of said body portion.

7. The archery bow of claim 1, wherein said cable engaging portion comprises a roller.

8. The archery bow of claim 1, wherein a location of said cable engaging portion is fixed along the length of the body portion.

9. The archery bow of claim 1, wherein the cable engaging portion comprises a first groove and a second groove, a portion of the first cable is oriented in the first groove and a portion of the second cable is oriented in the second groove.

10. The archery bow of claim 1, wherein said cable engaging portion comprises a first pulley and a second pulley.

11. The archery bow of claim 1, wherein a contact area between said cable guard and said first cable is smaller in the drawn condition than in the brace condition.

12. The archery bow of claim 1, said cable guard comprising a safety bar.

13. The archery bow of claim 1, wherein said body portion comprises open cavities.

14. The archery bow of claim 1, wherein said cable guard forms a closed structure that extends around said first cable.

15. The archery bow of claim 14, wherein said closed structure comprises a removable portion.

16. The archery bow of claim 1, said cable guard comprising a journal supporting a roller, said body portion defining a longitudinal axis, wherein an axis of said journal is not orthogonal to said longitudinal axis.

17. The archery bow of claim 16, wherein an axis of said journal is oriented at an angle to said longitudinal axis, said angle ranging from 45 to 85 degrees.

18. The archery bow of claim 1, wherein said body portion comprises a shaft and a repositionable member, said repositionable member fixedly attached to said shaft by a removable fastener.

19. The archery bow of claim 18, said repositionable member comprising a groove and a shaft lumen, wherein said first cable is retained in said groove by said shaft when said shaft extends through said shaft lumen.

20. An archery bow having a brace condition and a drawn condition, the archery bow comprising:

a riser comprising a grip, a first limb and a second limb;

a drawstring extending between the first limb and the second limb;

a first cable extending between the first limb and the second limb;

a second cable extending between the first limb and the second limb; and a cable guard attached to the riser, the cable guard comprising a body portion and a cable engaging portion, the cable guard biasing a portion of said first cable away from the riser, the cable guard biasing a portion of said second cable away from the riser;

wherein the archery bow defines a shooting axis and the biasing comprises a component oriented parallel to the shooting axis and directed away from the riser;

wherein the first limb supports a first axle and the second limb supports a second axle, the first axle comprising a first axis, the second axle comprising a second axis; wherein a reference plane is defined that includes the first axis and the second axis; and wherein a portion of the cable guard extends through the reference plane.

* * * * *